US008172616B2

(12) United States Patent
Miyazaki et al.

(10) Patent No.: US 8,172,616 B2
(45) Date of Patent: May 8, 2012

(54) ELECTRICAL CONNECTOR

(75) Inventors: Atsuhiro Miyazaki, Tokyo (JP); Ikuo Denpouya, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/877,236

(22) Filed: Sep. 8, 2010

(65) Prior Publication Data

US 2011/0076887 A1 Mar. 31, 2011

(30) Foreign Application Priority Data

Sep. 25, 2009 (JP) ..... 2009-220265

(51) Int. Cl.
*H01R 9/03* (2006.01)

(52) U.S. Cl. ..... 439/607.55

(58) Field of Classification Search . 439/607.55–607.58
See application file for complete search history.

(56) References Cited

U.S. PATENT DOCUMENTS 7,252,549 B2 * 8/2007 Nishio et al. ..... 439/607.55
7,364,464 B2 * 4/2008 Iino et al. ..... 439/607.55

FOREIGN PATENT DOCUMENTS

JP 2006-147353 A 6/2006
JP 2008-277020 A 11/2008
JP 2009-048978 A 3/2009
JP 2009-081125 A 4/2009
JP 2009-129731 6/2009

OTHER PUBLICATIONS

Office Action to Japanese Patent Application JP2009-220265, Jul. 12, 2011, Japanese Patent Office.

* cited by examiner

*Primary Examiner* — Khiem Nguyen
(74) *Attorney, Agent, or Firm* — Kubotera & Associates, LLC

(57) ABSTRACT

An electrical connector has a housing for arranging and holding terminals; and an upper shell and a lower shell formed of a metal plate and attached to the housing. The upper shell and the lower shell extend with a longitudinal direction thereof aligned with an arrangement direction of the terminals. The upper shell and the lower shell are directly connected to each other with solder at both end portions thereof in the longitudinal direction. At least one of the upper shell and the lower shell includes a protruding piece at a middle portion thereof. The other of the upper shell and the lower shell includes a hole portion or a cut portion as a receiving portion for receiving the protruding piece. The housing includes a through space portion for passing the protruding piece, so that the protruding piece is connected to a surrounding portion of the receiving portion with solder.

7 Claims, 5 Drawing Sheets

ELECTRICAL CONNECTOR

BACKGROUND TECHNOLOGY AND RELATED TECHNOLOGY

The present invention relates to an electrical connector having a shell member.

Patent Reference has disclosed a conventional electrical connector. In the conventional electrical connector, a plurality of terminals (contacts) is arranged and held in a housing (an insulating body). An upper shell (a plug shell) and a lower shell (a ground bar shell) each formed of a metal plate are attached to the housing. The upper shell and the lower shell extend such that a longitudinal direction thereof is aligned with an arrangement direction of the terminals, and have opposing parallel surfaces, respectively.

Patent Reference: Japanese Patent Publication No. 2009-129731

In the conventional electrical connector described above, a large number of the terminals are arranged in the housing. When the conventional electrical connector is attached to a circuit board, it is necessary to reduce a size of the conventional electrical connector. Accordingly, it is necessary to form the housing in an elongated shape with a small width and a thin wall. As a result, the upper shell and the lower shell need to be in an elongated shape with a small width and a thin wall. As a whole configuration of the conventional electrical connector, the housing, the upper shell, and the lower shell tend to easily deform at a middle portion in the longitudinal direction thereof.

In the conventional electrical connector described above, the upper shell and the lower shell are directly connected to each other with solder at both end portions thereof in the longitudinal direction. Accordingly, the upper shell and the lower shell are not connected with a sufficient strength, thereby making it easy to deform at the middle portion of the conventional electrical connector in the longitudinal direction thereof.

An object of the invention is to provide an electrical connector capable of solving the problems of the conventional electrical connector. In the present invention, an upper shell and a lower shell are attached to a housing with a sufficient strength at a middle portion of the electrical connector in a longitudinal direction thereof.

Further objects and advantages of the invention will be apparent from the following description of the invention.

SUMMARY OF THE INVENTION

In order to attain the objects described above, according to a first aspect of the present invention, an electrical connector has a housing for arranging and holding a plurality of terminals; and an upper shell and a lower shell formed of a metal plate and attached to the housing. The upper shell and the lower shell extend such that a longitudinal direction thereof is aligned with an arrangement direction of the terminals, and have opposing parallel surfaces, respectively. The upper shell and the lower shell are directly connected to each other with solder at both end portions thereof in the longitudinal direction.

According to the first aspect of the present invention, at least one of the upper shell and the lower shell includes a protruding piece at a middle portion thereof between the both end portions thereof in the longitudinal direction. The other of the upper shell and the lower shell includes a hole portion or a cut portion as a receiving portion for receiving the protruding piece. The housing includes a through space portion for passing the protruding piece, so that the protruding piece passing though the through space portion is connected to a surrounding portion of the receiving portion with solder.

In the first aspect of the present invention, the upper shell and the lower shell are connected to each other with solder at the both end portions thereof in the longitudinal direction. Further, the protruding piece of the one of the upper shell and the lower shell passing though the through space portion is connected to the surrounding portion of the receiving portion of the other of the upper shell and the lower shell with solder at the middle portion in the longitudinal direction. Accordingly, the upper shell and the lower shell are connected at the middle portion, thereby increasing strength of the upper shell and the lower shell and an entire portion of the electrical connector.

It is noted that, when the receiving portion receives the protruding piece, the protruding piece enters and passes through the receiving portion, or a distal end portion of the protruding piece is situated near an opening portion of the receiving portion.

According to a second aspect of the present invention, the protruding piece is formed in a bent shape perpendicular to a plate surface of a main body portion of the one of the upper shell and the lower shell. When the protruding piece is formed in the bent shape, it is possible to increase strength of the protruding piece.

According to a third aspect of the present invention, the protruding piece is preferably arranged such that the distal end portion thereof is situated in the receiving portion of the other of the upper shell and the lower shell within a plate thickness range of the other of the upper shell and the lower shell. Accordingly, it is possible to securely connect the protruding piece to an inner wall surface of the receiving portion with solder. Further, the distal end portion of the protruding piece is situated within the plate thickness range of the other of the upper shell and the lower shell, so that the protruding piece does not protrude from a surface of the other of the upper shell and the lower shell, thereby making it possible to maintain a small height of the electrical connector.

According to a fourth aspect of the present invention, the protruding piece is preferably formed such that a circumferential surface thereof contacts with a wall surface of the through space portion. Accordingly, the protruding piece blocks the through space portion, so that solder adhering to the protruding piece does not leak downwardly through a space between the protruding piece and the wall surface.

According to a fifth aspect of the present invention, the through space portion of the housing is formed of a hole portion. The housing has a recess portion formed in a wall surface facing the other of the upper shell and the lower shell around the hole portion. Accordingly, solder applied to the protruding piece tends to stay in the recess portion, and does not spread in a surrounding area. As a result, it is possible to prevent solder from scattering into an unnecessary area and apply solder only at a necessary area, thereby preventing strength from lowering.

According to a sixth aspect of the present invention, the recess portion of the housing is arranged such that a circumferential edge of the recess portion surrounds the receiving portion of the other of the upper shell and the lower shell viewed in a vertical direction. Further, the receiving portion of the other of the upper shell and the lower shell has a solder attachment promoting surface facing the recess portion at a circumference thereof. Accordingly, solder applied to the protruding piece is attached to the solder attachment promoting surface facing the recess portion, in addition to the inner wall surface of the receiving portion, thereby increasing connecting strength.

In the sixth aspect of the present invention, the solder attachment promoting surface may be formed through plating a high solder compatible material. When the receiving portion is formed through a punching process, a material of the terminal is exposed at the inner wall surface of the receiving portion, thereby forming the solder attachment promoting surface as is.

As described above, in the present invention, at least one of the upper shell and the lower shell includes the protruding piece at the middle portion thereof in the longitudinal direction. The other of the upper shell and the lower shell includes the receiving portion for receiving the protruding piece. The protruding piece is connected to the surrounding portion of the receiving portion with solder. Accordingly, even when the electrical connector has a long length, the upper shell and the lower shell are connected at the middle portion with increased strength. As a result, it is possible to prevent the upper shell and the lower shell from coming off from the housing, and reduce deformation of the electrical connector due to increased strength thereof, thereby securing connecting reliability of solder connection between the electrical connector and a cable.

DETAILED DESCRIPTION OF THE PREFERRED EMBODIMENTS

Figure 1:
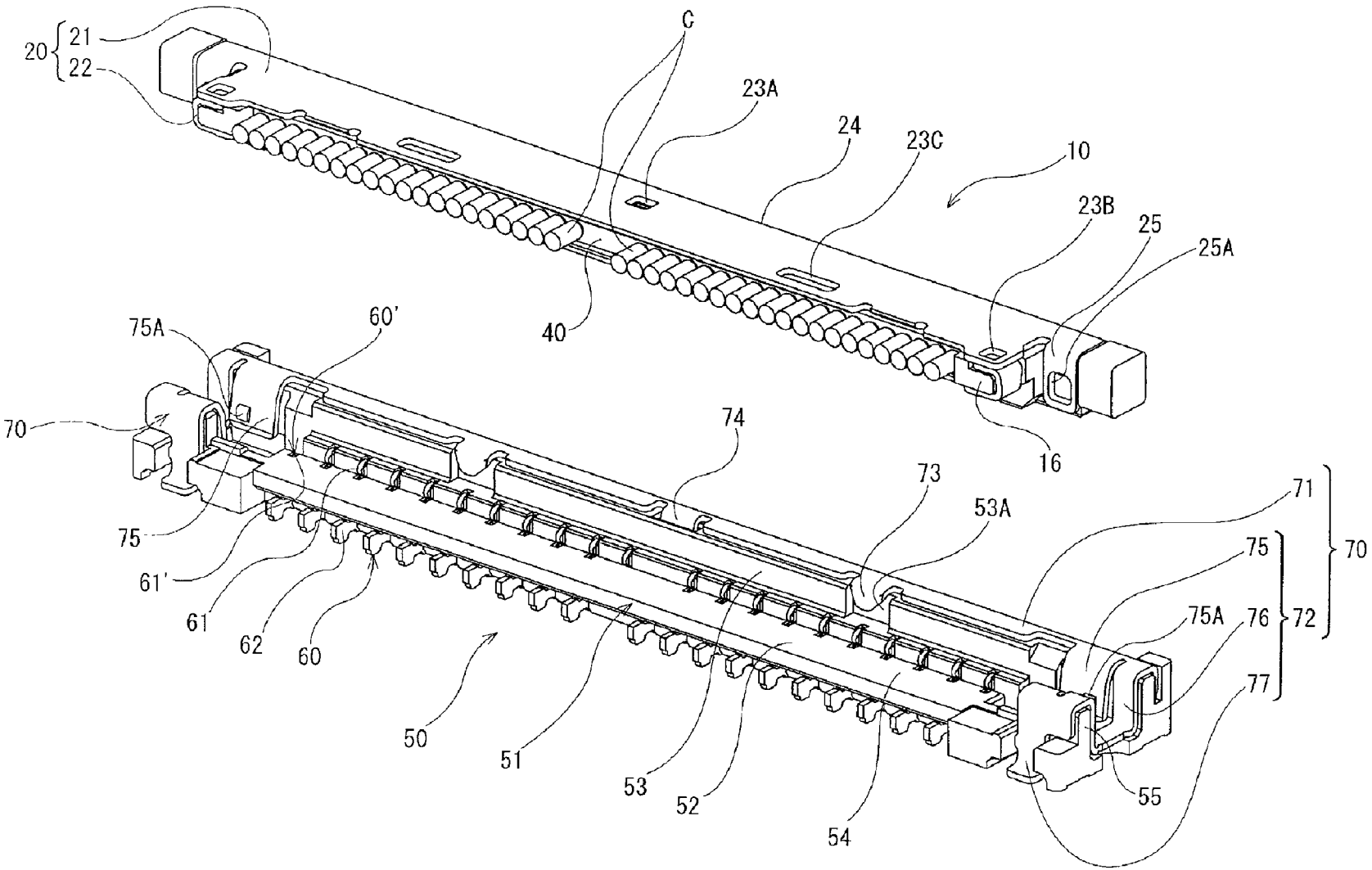
FIG. 1 is a perspective view showing a cable connector and a circuit board connector as a mating connector in a state that the cable connector is disconnected from the circuit board connector according to an embodiment of the invention.

Hereunder, embodiments of the invention will be described with reference to the accompanying drawings. FIG. 1 is a perspective view showing a cable connector 10 and a circuit board connector 50 as a mating connector in a state that the cable connector 10 is disconnected from the circuit board connector 50 according to an embodiment of the invention.

As shown in FIG. 1, the cable connector 10 is connected to a plurality of cables C each formed of a coaxial cable. The circuit board connector 50 as the mating connector is to be attached to a circuit board (not shown). When the cable connector 10 is connected to the circuit board connector 50 from above, the cables C extend in parallel to the circuit board. The cable connector 10 includes a housing 11 for holding terminals 30 (refer to FIG. 2) and a shell member 20 attached to the housing 11. The shell member 20 is formed of an upper shell 21 and a lower shell 22 each formed of a metal plate. It is noted that each of the cable connector 10 and the circuit board connector 50 as the mating connector has a symmetrical shape in a lateral direction thereof.

Figure 2:
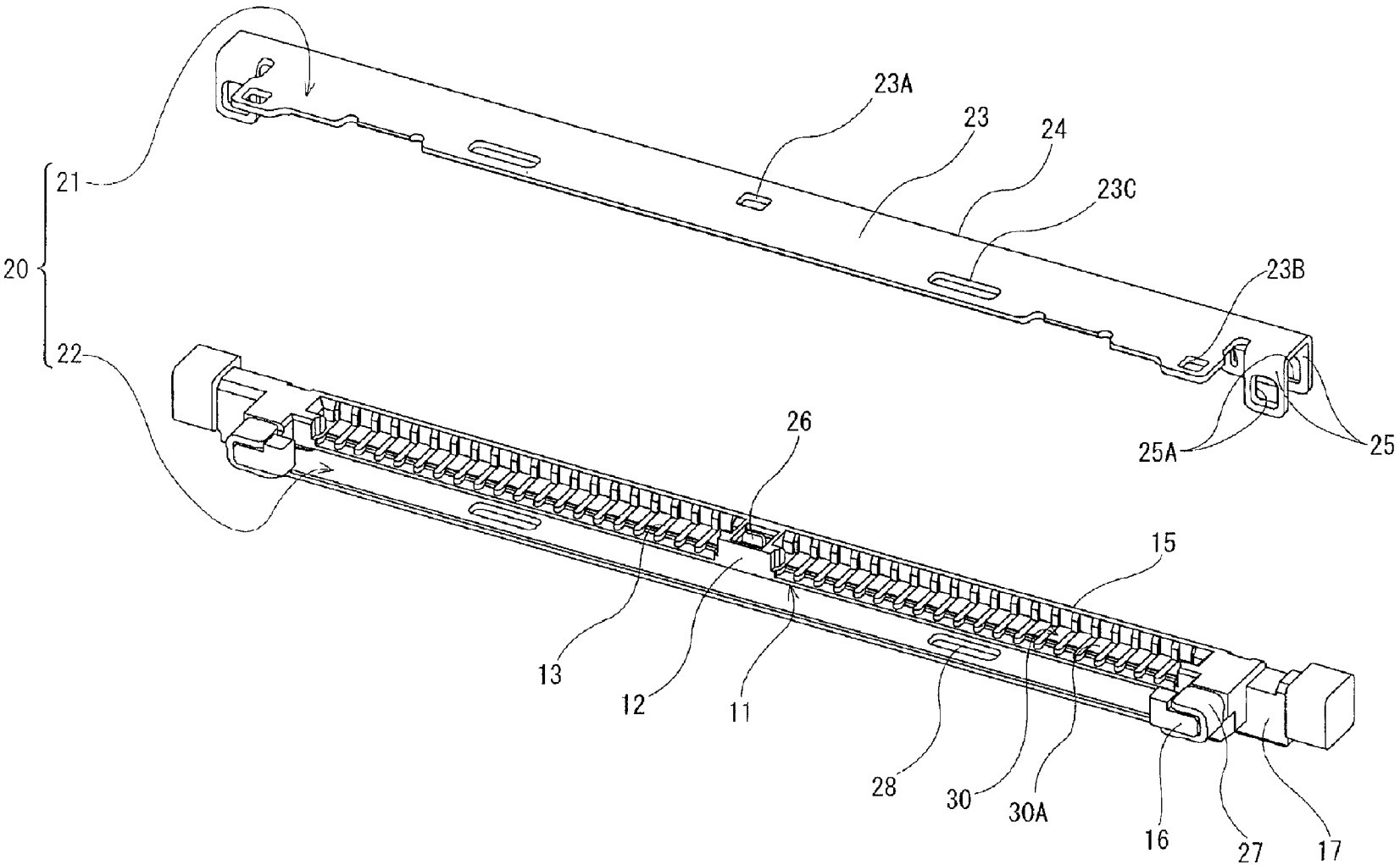
FIG. 2 is a perspective view showing the cable connector in a state that a lower shell thereof is attached to a housing thereof and an upper shell thereof is removed from the housing according to the embodiment of the invention.
Figure 3:
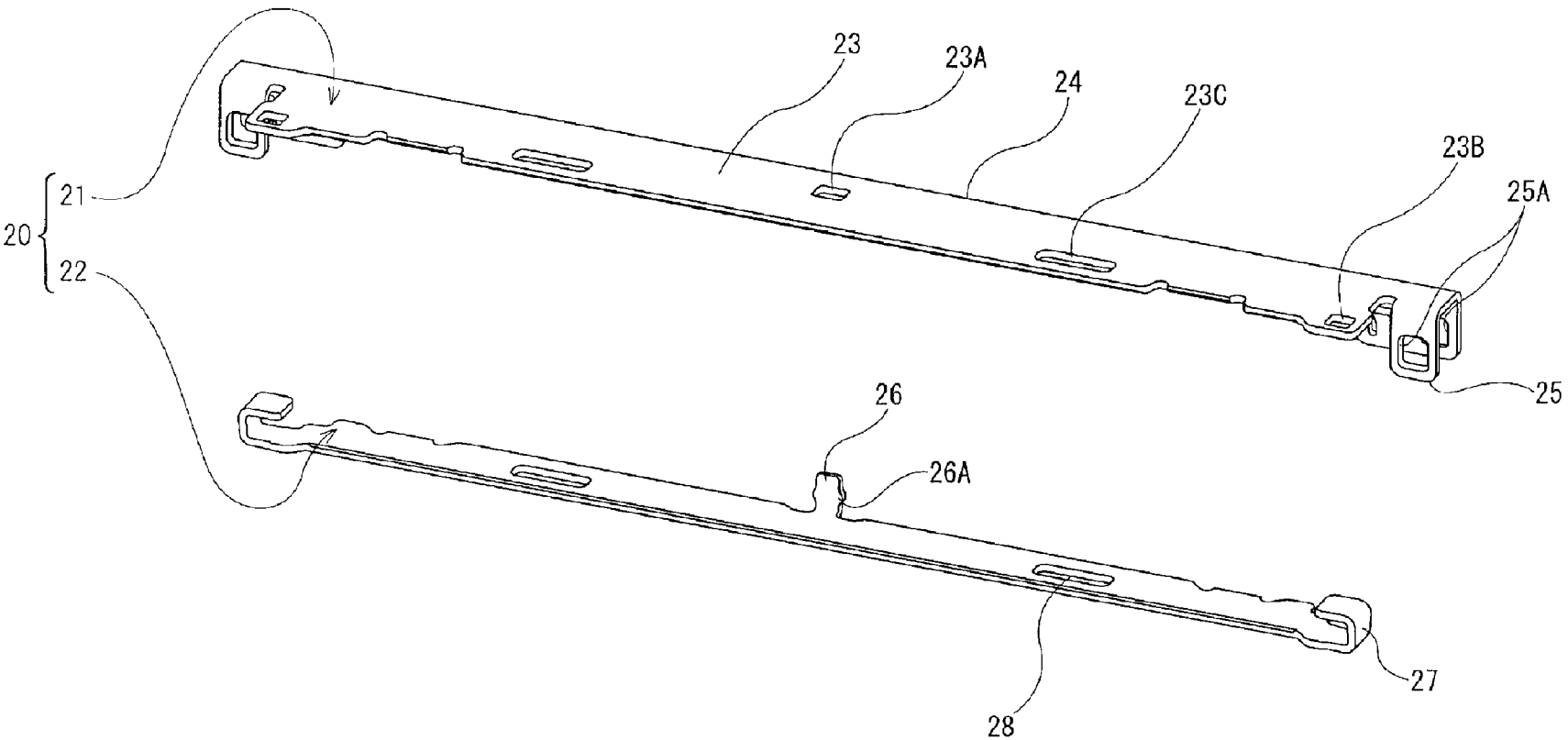
FIG. 3 is a perspective view showing the upper shell and the lower shell of the cable connector according to the embodiment of the invention.

FIG. 2 is a perspective view showing the cable connector 10 in a state that the lower shell 22 is attached to the housing 11 and the upper shell 21 is removed from the housing 11 according to the embodiment of the invention. FIG. 3 is a perspective view showing the upper shell 21 and the lower shell 22 of the cable connector 10 according to the embodiment of the invention.

As shown in FIG. 2, the housing 11 includes a fixing portion 12 formed in a block shape at a center portion thereof in a longitudinal direction thereof. A plurality of terminals 30 is held and arranged between both side end portions of the housing 11 on both sides of the fixing portion 12. Further, the housing 11 includes a recess portion 13 opening in an extending direction of the cables C and an upper direction in an arrangement range of the terminals 30. Each of the terminals 30 includes a cable connecting portion 30A having an upper surface exposed from a bottom surface of the recess portion 13 and a contacting portion (not shown) exposed from an outer side surface of a sidewall 15 of the recess portion 13.

In the embodiment, a ground bar 40 (refer to FIG. 1) is provided for holding the cables C. A core wire of each of the cables C protrudes from the ground bar 40, so that the core wire is placed on the cable connecting portion 30A to be connected with solder.

Figure 4:
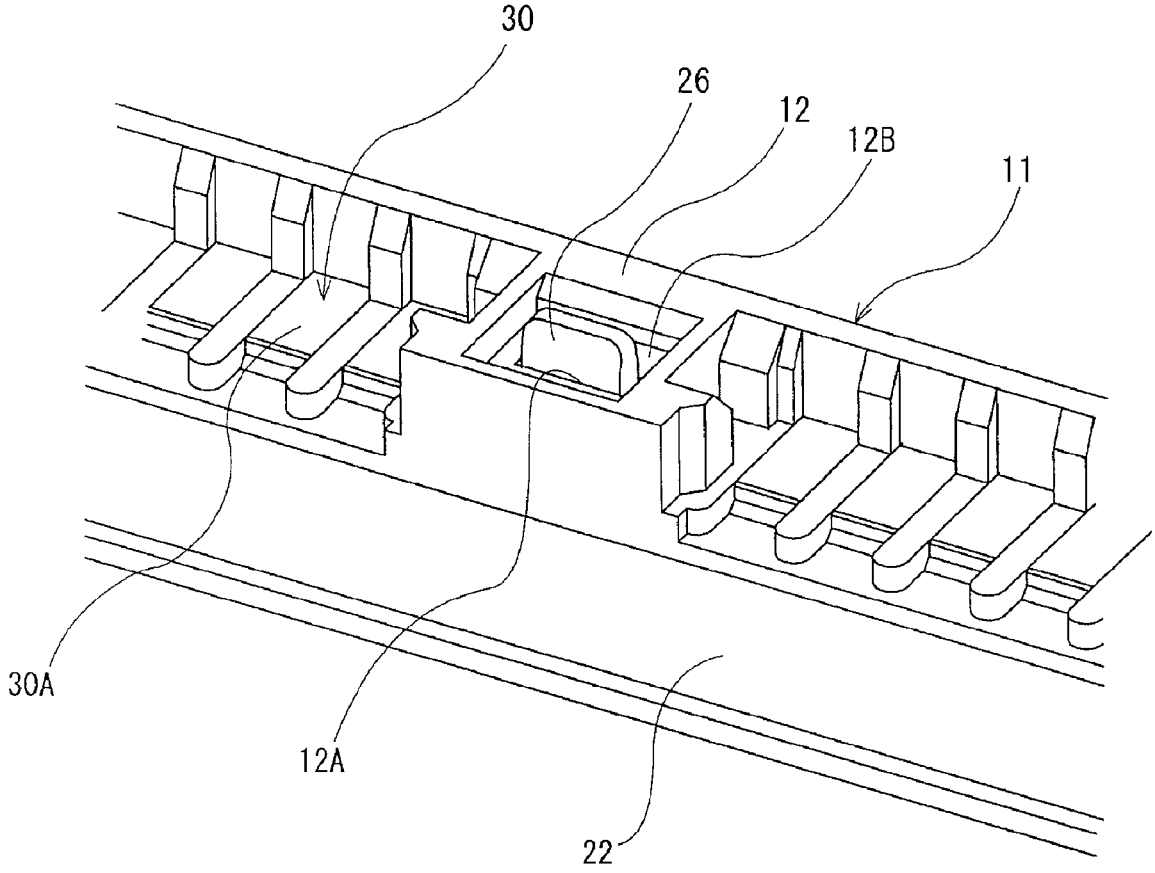
FIG. 4 is a perspective view showing a fixing portion of the cable connector disposed at a center portion of the cable connector in a longitudinal direction thereof and a surrounding area of the fixing portion according to the embodiment of the invention.
Figure 5:
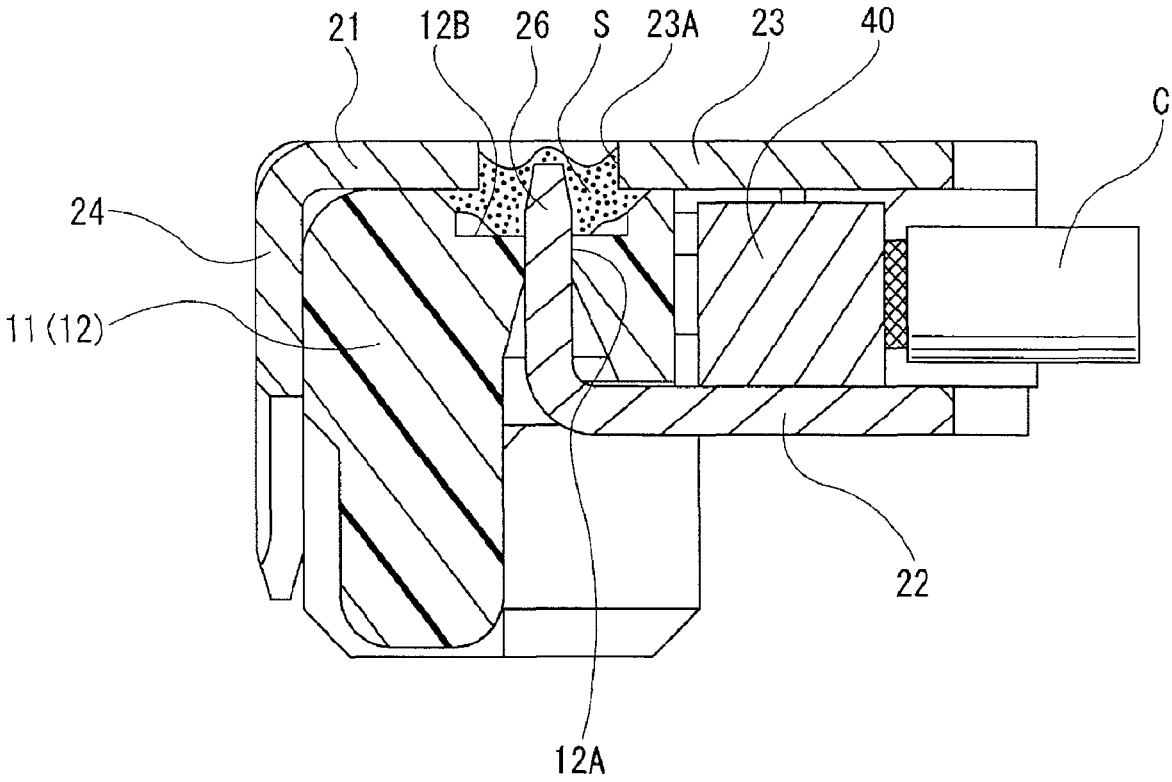
FIG. 5 is a sectional view showing the fixing portion of the cable connector according to the embodiment of the invention.

FIG. 4 is a perspective view showing the fixing portion 12 of the cable connector 10 disposed at the center portion of the cable connector 10 in the longitudinal direction thereof and a surrounding area of the fixing portion 12 according to the embodiment of the invention. FIG. 5 is a sectional view showing the fixing portion 12 of the cable connector 10 according to the embodiment of the invention.

As shown in FIGS. 4 and 5, the fixing portion 12 of the housing 11 has a through space portion 12A formed in a slit shape and penetrating the fixing portion 12 in a vertical direction. The through space portion 12A has a size in a width direction of the housing 11 (corresponding to the cable extending direction) substantially the same as a plate thickness of a protruding piece 26 of the lower shell 22 (described later). The through space portion 12A has a size in the longitudinal direction of the housing 11 substantially the same as a width of the protruding piece 26 of the lower shell 22. Accordingly, it is possible to tightly or freely fit the protruding piece 26 in the engaging protrusions 26A. Further, the fixing portion 12 includes a recess portion 12B formed in a range surrounding an opening portion of the through space portion 12A.

As shown in FIGS. 1 and 2, the housing 11 has lower shell supporting portions 16 protruding in the cable extending direction outside the arrangement range of the terminals 30 at the both side end portions of the housing 11 in the longitudinal direction thereof. Further, the housing 11 has upper shell supporting portions 17 situated outside the lower shell supporting portions 16 in the longitudinal direction of the housing 11.

In the embodiment, the upper shell 21 includes an upper surface portion 23 for covering the housing 11 from above over a range between the upper shell supporting portions 17 at the side end portions of the housing 11 in the longitudinal direction and a range between the sidewall 15 and the lower shell supporting portions 16 in a width direction of the housing 11. Further, the upper shell 21 includes a backside surface portion 24 facing an outer surface of the sidewall 15 above the contact portions of the terminals 30 exposed from the sidewall 15 of the housing 11. Further, the upper shell 21 includes a pair of leg portions 25 extending downwardly from side end edges of the upper surface portion 23 in the width direction at positions corresponding to both side surfaces of the upper shell supporting portions 17 of the housing 11 at the side end portions in the longitudinal direction.

In the embodiment, the upper surface portion 23 includes a receiving portion 23A as a hole portion at a center portion thereof in the longitudinal direction and connecting holes 23B at both side end portions thereof in the longitudinal direction in an edge portion in the cable extending direction, so that the upper surface portion 23 is connected to the lower shell 22 with solder. Further, the upper surface portion 23 includes long holes 23C in the edge portion in the cable extending direction so that the upper surface portion 23 is connected to an upper surface of the ground bar 40 with solder (described later). Each of the leg portions 25 includes a locking hole 25A for engaging the mating connector (described later). It is noted that the receiving portion 23A is formed in the hole portion, and may be formed in a cut portion.

As shown in FIG. 3, the lower shell 22 extends before the leg portions 25 of the upper shell 21 in the longitudinal direction, and extends over a range corresponding to a protruding length of the lower shell supporting portions 16 of the housing 11 in the width direction or the cable extending direction. Accordingly, the lower shell 22 has a length smaller than that of the upper shell 21 in the longitudinal direction, and a width smaller than that of the upper shell 21 in the width direction.

In the embodiment, the lower shell 22 includes the protruding piece 26 in a bent shape extending upwardly from an edge portion thereof on a side of the sidewall 15 of the housing 11 at a center portion thereof in the longitudinal direction. It is noted that the protruding piece 26 is formed at a position such that the protruding piece 26 can enter the receiving portion 23A of the upper shell 21. The protruding piece 26 has a width substantially the same as a corresponding inner width of the receiving portion 23A. The protruding piece 26 includes engaging protrusions 26A on side edges thereof. When the protruding piece 26 is fitted in the through space portion 12A of the housing 11, the engaging protrusions 26A engage corresponding inner wall surfaces of the through space portion 12A.

In the embodiment, the protruding piece 26 has a height such that a distal end portion thereof is situated in the receiving portion 23A of the upper shell 21 within a plate thickness range of the upper shell 21 at an inner edge of the receiving portion 23A. More specifically, the distal end portion of the protruding piece 26 is situated within the plate thickness range of the upper shell 21 at the receiving portion 23A, and may be situated at a position corresponding to an upper surface of the upper shell 21 around the receiving portion 23A or a lower surface of the upper shell 21 around the receiving portion 23A, or a position slightly lower than the lower surface of the upper shell 21. When the distal end portion of the protruding piece 26 is situated at a position slightly lower than the lower surface of the upper shell 21, the position should be within a range such that solder to be attached to the protruding piece 26 can spread to the lower surface through a viscous flow.

In the embodiment, the lower shell 22 includes supported portions 27 formed in a lateral U character shape at both end portions thereof in the longitudinal direction. Each of the supported portions 27 is formed in a bent shape bent upwardly from the end portion in the longitudinal direction and further bent toward a center portion in the longitudinal direction. The supported portions 27 are formed at positions and have a shape such that the lower shell supporting portions 16 of the housing 11 are fitted in the supported portions 27 sideways.

In the embodiment, the lower shell 22 further includes long holes 28 at positions between the protruding piece 26 and the supported portions 27 in the longitudinal direction so that the lower shell 22 is connected to a lower surface of the ground bar 40 with solder.

As described above, the ground bar 40 holds the cables C as shown in FIG. 1. More specifically, the ground bar 40 is formed of a metallic material, and contacts with shield wire portions of the cables C to hold the cables C. The cables C are arranged such that the core wires thereof protrude from the ground bar 40 on an opposite side to a cable extending side as shown in FIG. 1.

In the embodiment, when the ground bar 40 holding the cables C is placed on the lower shell 22 between the lower shell supporting portions 16 at the side end portions of the housing 11, the lower surface of the ground bar 40 contacts with the upper surface of the lower shell 22, and the core wires of the cables C are situated on the cable connecting portions 30A of the terminals 30. Afterward, the core wires of the cables C are connected to the cable connecting portions 30A with solder as shown in FIGS. 2 and 4. When the upper shell 21 is attached to the housing 11, the upper surface of the ground bar 40 contacts with the lower surface of the upper shell 21 at the side edge portions thereof.

A configuration of the circuit board connector 50 will be explained next in more detail. As shown in FIG. 1, the circuit board connector 50 includes a housing 51 for holding terminals 60 and a ground plate 70 attached to the housing 51. The housing 51 includes a bottom wall 52 and a sidewall 53, so that the bottom wall 52 and the sidewall 53 form a receiving space 54 for receiving the cable connector 10. The receiving space 54 opens opposite to the sidewall 53, so that the cables C of the cable connector 10 extend therethrough.

In the embodiment, the terminals 60 held with the housing 51 include two types of terminals 60 and 60' arranged alternately. Each of the terminals 60 includes a contact portion 61 situated on a side of an inner surface of the sidewall 53 of the housing 51 and a connecting portion 62 situated at a lower side of the bottom wall 52. Each of the terminals 60' includes a contact portion 61' at a position shifted by a half of an arrangement pitch of the terminals 60. Each of the terminals 60' includes a connecting portion (not shown) situated outside the sidewall 53 at an opposite side to the extending side of the cables C. The contact portions 61 and 61' of the terminals 60 and 60' are situated at positions corresponding to the contact portions of the terminals 30 of the cable connector 10.

In the embodiment, the ground plate 70 attached to the housing 51 includes a shield portion 71 for covering an upper surface and an outer surface of the sidewall 53 of the housing 51 and ground portions 72 at both end portions thereof in a longitudinal direction of the housing 51. The shield portion 71 includes contact pieces 73 and a fixing piece 74 formed in a tongue shape bent on a side of the inner surface of the sidewall 53.

In the embodiment, each of the contact pieces 73 has a base portion accommodated in a groove portion 53A formed in the inner surface of the sidewall 53. More specifically, each of the contact pieces 73 has the base portion accommodated in the groove portion 53A and a distal end portion protruding from the groove portion 53A toward outside, so that the contact piece 73 can contact with the shell member 20 of the cable connector 10. The fixing piece 74 is tightly fitted in a slit formed in the upper surface of the sidewall 53.

In the embodiment, each of the ground portions 72 includes a locking piece 75, a supported portion 76, and a fixed portion 77. The housing 51 includes opposite walls 55 at the both end portions in the longitudinal direction corresponding to the ground portions 72, so that the opposite walls 55 face the sidewall 53 in the extending direction of the cables C. The ground portions 72 are attached to the sidewall 53 and the opposite walls 55. The locking piece 75 and the supported portion 76 are situated on a side of opposite inner surfaces of the sidewall 53 and the opposite walls 55, and the fixed portion 76 is situated on a side of outer surfaces of the sidewall 53 and the opposite walls 55. The supported portion 76 is situated on an end portion side with respect to the locking piece 75 in the longitudinal direction, and the fixed portion 77 is situated at a position the same as that of the locking portion 75.

In the embodiment, the locking piece 75 is formed in a cantilever shape extending downwardly from a position corresponding to the upper surfaces of the sidewall 53 and the opposite walls 55 in an inclined state, so that the locking piece 75 has elasticity. Further, the locking piece 75 has a locking protrusion 75A formed in an opposite inner surface thereof for engaging a locking hole 25A formed in the leg portion 25 of the upper shell 21 of the cable connector 10.

In the embodiment, the supported portion 76 is formed in an inverted U character shape, so that the supported portion 76 is attached and supported with the sidewall 53 and the opposite wall 55. More specifically, the supported portion 76 has a U character shape portion having portions extending along the sidewall 53 and the opposite wall 55 connected with a portion extending along a bottom wall between the sidewall 53 and the opposite wall 55. The supported portions 76 are provided for receiving the both end portions of the cable connector 10 in the U character shape portion.

In the embodiment, the fixed portion 77 is formed in an L character shape bent outside the housing 51. Further, the fixed portion 77 has a portion facing the circuit board, so that the portion is connected to the circuit board with solder.

A process of assembling the cable connector 10 and connecting the cable connector 10 to the circuit board connector 50 as the mating connector will be explained next.

In assembling the cable connector 10, first, the protruding piece 26 of the lower shell 22 is inserted into the through space portion 12A of the housing 11 from below and the supported portions 27 are attached to the housing 11, so that the lower shell 22 is attached to the housing 11 (refer to FIG. 2). In this state, the engaging protrusions 26A formed on the side edges of the protruding piece 26 bite into the inner wall surface of the through space portion 12A while the protruding piece 26 contacts with or is away from the inner wall surface of the through space portion 12A, thereby preventing the lower shell 22 from coming off from the housing 11.

In the next step, the ground bar 40 with the cables C arranged and held thereon is placed on the lower shell 22 shown in FIG. 2. In this state, the core wires of the cables C are situated on the cable connecting portions 30A of the terminals 30, so that the core wires can be connected to the cable connecting portions 30A with solder. Further, the lower shell 22 is connected to the ground bar 40 with solder through the long holes 28, so that the lower shell 22 is electrically and physically connected to the ground bar 40.

In the next step, the upper shell 21 is attached to the housing 11. More specifically, the leg portions 25 of the upper shell 21 are attached to and supported with the upper shell supporting portions 17 of the housing 11 in a straddling state. In this state, the connecting holes 23B of the upper shell 21 contact with or are away from the upper surface of the lower shell 22 in the lateral U character shape, and the long holes 23C of the upper shell 21 contact with or are away from the upper surface of the ground bar 40 on the lower shell 22. Further, the distal end portion (the upper end portion) of the protruding piece 26 of the lower shell 22 penetrates through the through space portion 12A of the housing 11 from below, and protrudes from the bottom surface of the through space portion 12A formed in the upper surface of the fixing portion 12 of the housing 11 (refer to FIG. 4). Accordingly, the distal end portion of the protruding piece 26 enters the receiving portion 23A of the upper shell 21.

After the upper shell 21 is attached to the housing 11, as shown in FIG. 5, the distal end portion of the protruding piece 26 is attached to the upper shell 21 with solder S in the recess portion 12B, so that the protruding piece 26 is electrically and physically connected to the upper shell 21. At this moment, the solder S spreads into a space between the lower surface of the upper shell 21 and the housing 11 at the circumferential edge of the receiving portion 23A of the upper shell 21, so that the protruding piece 26 is strongly connected to the upper shell 21. It is noted that the upper shell 21 contacts with or is away from the inner wall surface of the through space portion 12A to form only a slight space, thereby preventing the solder S from leaking downwardly.

In the next step, the upper shell 21 is connected to the lower shell 22 through the connecting holes 23B with the solder S, and is connected to the ground bar 40 through the long holes 23C with the solder S. Accordingly, the upper shell 21 is electrically and physically connected to the lower shell 22.

In the embodiment, the circuit board connector 50 as the mating connector is connected to the circuit board. More specifically, as shown in FIG. 1, the circuit board connector 50 is placed at a specific position on the circuit board, and the connecting portions 62 of the terminals 60 are connected to corresponding portions of the circuit board with solder. Further, the fixed portions 77 of the ground plate 70 are connected to corresponding portions of the circuit board with solder.

In connecting the cable connector 10 to the circuit board connector 50, the cable connector 10 is connected to the circuit board connector 50 from above. More specifically, the cable connector 10 is accommodated in the receiving space 54 formed with the sidewall 53 and the bottom wall 52 of the circuit board connector 50, so that the both end portions of the cable connector 10 are retained in the U character shape portions of the supported portions 76. Further, the locking protrusions 75A of the locking pieces 75 of the circuit board connector 50 engage the locking holes 25A formed in the leg portions 25 at the both end portions of the cable connector 10. Accordingly, the terminals 30 of the cable connector 10 contact with the contact portions 61 of the terminals 60 of the circuit board connector 50, so that the cable connector 10 is electrically connected to the circuit board connector 50.

The present invention is not limited to the embodiment described above, and may be modified. For example, in the embodiment, the protruding piece 26 is formed on the lower shell 22 and the receiving portion 23A is formed in the upper shell 21. Alternatively, the protruding piece 26 may be formed on the upper shell 21 and the receiving portion 23A may be formed in the lower shell 22. Further, the protruding piece 26 may be formed on one or both of the lower shell 22 and the upper shell 21 at a plurality of positions in the middle portion between the both end portions, and the receiving portion 23A may be formed in the other or both of the lower shell 22 and the upper shell 21.

The disclosure of Japanese Patent Application No. 2009-220265, filed on Sep. 25, 2009 is incorporated in the application by reference.

While the invention has been explained with reference to the specific embodiments of the invention, the explanation is illustrative and the invention is limited only by the appended claims.

What is claimed is:

1. An electrical connector, comprising:

a terminal;

a housing for arranging and holding the terminal;

an upper shell attached to the housing; and a lower shell attached to the housing and connected to the upper shell at both end portions thereof in a longitudinal direction, at least one of said upper shell and said lower shell including a protruding piece at a middle portion thereof, the other of said upper shell and said lower shell including a receiving portion for receiving the protruding piece, wherein said housing includes a through space portion for passing the protruding piece so that the protruding piece is connected to a surrounding portion of the receiving portion, said protruding piece is arranged so that a distal end portion thereof is situated in the receiving portion within a plate thickness range of the other of the upper shell and the lower shell, and said through space portion has a slit portion having a width substantially equal to a thickness of the protruding piece so that the slit portion tightly sandwiches the protruding piece from two sides.

2. The electrical connector according to claim 1, wherein each of said upper shell and said lower shell is formed of a metal plate.

3. The electrical connector according to claim 1, wherein said receiving portion is formed as a hole portion or a cut portion.

4. The electrical connector according to claim 1, wherein said protruding piece is formed in a bent shape perpendicular to a plate surface of the one of the upper shell and the lower shell.

5. The electrical connector according to claim 1, wherein said protruding piece is formed so that a circumferential surface thereof contacts with a wall surface of the through space portion.

6. The electrical connector according to claim 1, wherein said housing includes a recess portion facing the other of the upper shell and the lower shell around the receiving portion.

7. The electrical connector according to claim 6, wherein said recess portion is arranged so that a circumferential edge thereof surrounds the receiving portion, said receiving portion including a solder attachment promoting surface facing the recess portion at a circumference thereof.

* * * * *